US007444974B2

(12) United States Patent
Kotouge

(10) Patent No.: US 7,444,974 B2
(45) Date of Patent: Nov. 4, 2008

(54) INTERNAL COMBUSTION ENGINE INTAKE DEVICE

(75) Inventor: Atsurou Kotouge, Barcelona (ES)

(73) Assignee: Nissan Motor Co., Ltd., Yokohama (JP)

( * ) Notice: Subject to any disclaimer, the term of this patent is extended or adjusted under 35 U.S.C. 154(b) by 130 days.

(21) Appl. No.: 11/480,573

(22) Filed: Jul. 5, 2006

(65) Prior Publication Data

US 2007/0028883 A1 Feb. 8, 2007

(30) Foreign Application Priority Data

Jul. 11, 2005 (JP) ..... 2005-202072

(51) Int. Cl.
*F02M 35/10* (2006.01)

(52) U.S. Cl. ..... 123/184.35; 123/184.37; 123/184.43; 123/184.45; 123/184.48; 123/184.52

(58) Field of Classification Search ..... 123/184.38, 123/184.24, 184.25, 184.34, 184.35, 184.42, 123/184.43, 184.47, 184.48, 184.27, 184.36, 123/184.37, 184.45, 184.52
See application file for complete search history.

(56) References Cited

U.S. PATENT DOCUMENTS 4,957,071 A * 9/1990 Matsuo et al. ..... 123/184.36
4,970,994 A * 11/1990 Sawada et al. ..... 123/184.35
5,010,854 A * 4/1991 Suehiro et al. ..... 123/184.36
6,637,396 B2 * 10/2003 Katayama ..... 123/184.42
6,805,087 B2 * 10/2004 Yakabe et al. ..... 123/184.25
7,131,416 B2 * 11/2006 Sasaki et al. ..... 123/184.36
2007/0017490 A1 * 1/2007 Sasaki et al. ..... 123/568.17

FOREIGN PATENT DOCUMENTS

JP H07-324657 12/1995
JP H11-125159 11/1999

* cited by examiner

*Primary Examiner*—Willis R Wolfe, Jr.
(74) *Attorney, Agent, or Firm*—Globla IP Counselors, LLP

(57) ABSTRACT

An internal combustion engine intake device includes an intake collector and a first air induction pipe. The intake collector includes a first collector space and a second collector space. The first air induction pipe extends diagonally downward from an upstream side of the intake collector with respect to a horizontal direction of the vehicle. The first air induction pipe includes a first air induction space and a second air induction space. The intake collector and the first air induction pipe are configured and arranged such that a first boundary plane defined between the first collector space and the first air induction space is substantially perpendicular to a direction of an intake air flow from the first air induction space into the first collector space and the first boundary plane is substantially coplanar with a second boundary plane defined between the second collector space and the second air induction space.

13 Claims, 7 Drawing Sheets

INTERNAL COMBUSTION ENGINE INTAKE DEVICE

CROSS-REFERENCE TO RELATED APPLICATIONS

This application claims priority under 35 U.S.C. § 119 to Japanese Patent Application No. 2005-202072. The entire disclosure of Japanese Patent Application No. 2005-202072 is hereby incorporated herein by reference.

BACKGROUND OF THE INVENTION

1. Field of the Invention

The present invention relates to an intake device for an internal combustion engine.

2. Background Information

Japanese Laid-Open Patent Publication No. 11-125159 discloses a conventional internal combustion engine intake device including an intake collector, an air induction pipe that extends from an upstream side of the intake collector, and a plurality of intake branches that extend from a downstream side of the intake collector.

The conventional internal combustion engine intake device disclosed in the above mentioned reference achieves a compact intake device for a longitudinally-mounted engine having two cylinder banks by arranging two intake collectors to the left and right of each other.

In view of the above, it will be apparent to those skilled in the art from this disclosure that there exists a need for an improved internal combustion engine intake device. This invention addresses this need in the art as well as other needs, which will become apparent to those skilled in the art from this disclosure.

SUMMARY OF THE INVENTION

In the case of transversely-mounted engines, the intake collector is sometimes divided into an upper portion and a lower portion. Thus, the intake collectors of transversely-mounted engines tend to be high with respect to an engine hood (i.e., close to the engine hood). Furthermore, since the lengths of the air induction pipes connected to the upper and lower portions of the intake collector are sometimes different, the characteristics of the two cylinder banks tend to be less than perfectly balanced.

Accordingly, one object of the present invention is to provide an intake device that is configured and arranged such that the height of the intake collector can be lowered with respect to the engine hood and good balance can be ensured between the characteristics of the two cylinder banks.

In order to achieve the above mentioned object and other objects of the present invention, an internal combustion engine intake device is provided that comprises an intake collector and a first air induction pipe. The intake collector includes a first partitioning part that divides a space inside the intake collector into a first collector space located above the first partitioning part and a second collector space located below the first portioning part with respect to a vertical direction of a vehicle. The first air induction pipe extends diagonally downward from an upstream side of the intake collector with respect to a horizontal direction of the vehicle. The first air induction pipe includes a second partitioning part that divides a space inside the first air induction pipe into a first air induction space located above the second partitioning part and a second air induction space located below the second partitioning part with respect to the vertical direction of the vehicle with the first air induction space fluidly communicating with the first collector space and the second air induction space fluidly communicating with the second collector space. The intake collector and the first air induction pipe are configured and arranged such that a first boundary plane defined between the first collector space and the first air induction space is substantially perpendicular to a direction of an intake air flow from the first air induction space into the first collector space and the first boundary plane is substantially coplanar with a second boundary plane defined between the second collector space and the second air induction space.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiment of the present invention will now be explained with reference to the drawings. It will be apparent to those skilled in the art from this disclosure that the following description of the embodiment of the present invention is provided for illustration only and not for the purpose of limiting the invention as defined by the appended claims and their equivalents.

Overview of Structure of Internal Combustion Engine

Figure 1:
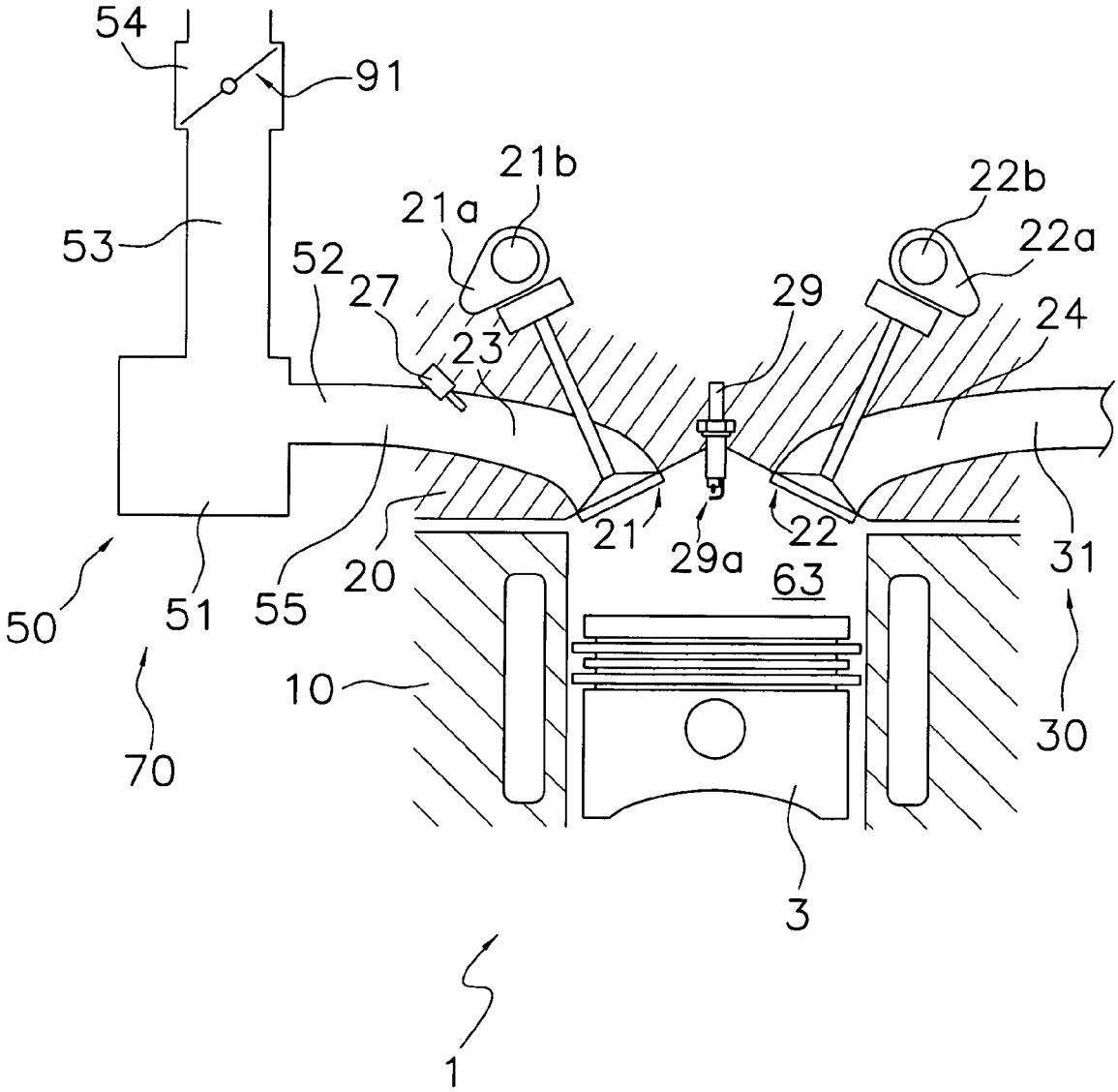
FIG. 1 is a schematic view of an internal combustion engine intake device in accordance with an embodiment of the present invention.
Figure 7:
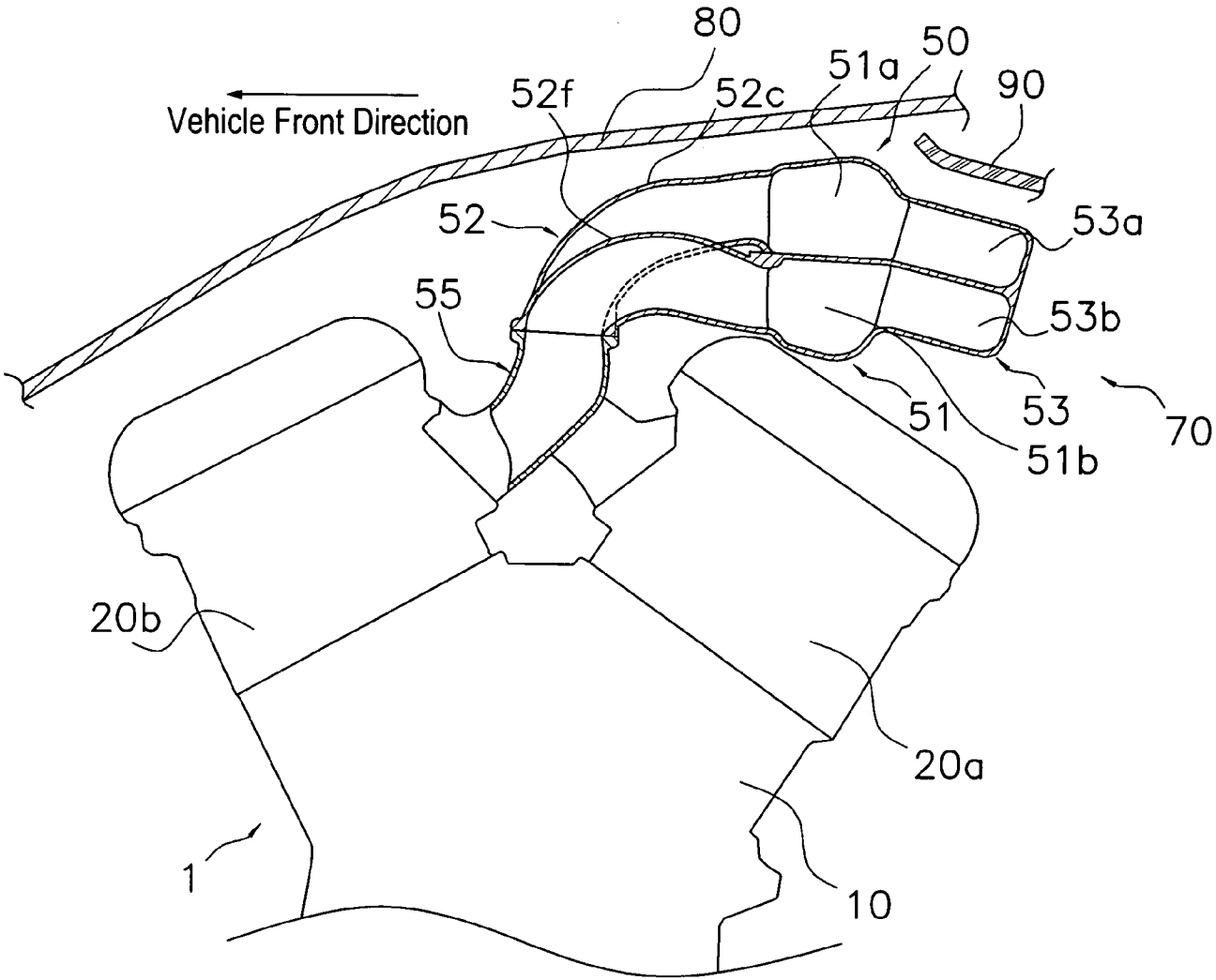
FIG. 7 is a partial cross sectional view illustrating arrangements of the internal combustion engine intake device, an internal combustion engine, an engine hood and a cowl top panel in accordance with the embodiment of the present invention.

FIG. 1 is a schematic view of an internal combustion engine intake device 70 coupled with an internal combustion engine 1 in accordance with the present invention. The engine 1 is, for example, a conventional V6 engine configured and arranged to execute air intake in a manner that utilizes resonance. The engine 1 is preferably mounted transversely inside an engine compartment at the front of a vehicle (i.e., a crankshaft (not shown) of the engine 1 is oriented to extend in a transverse direction of the vehicle). In the conventional V6 engine, the six cylinders are divided into a right-hand bank located on the right-hand side and a left-hand bank located on the left-hand side when the engine 1 is viewed from the lengthwise direction (FIG. 7). Each cylinder bank has the same number of cylinders.

The engine 1 includes six combustion chambers 63 (only one combustion chamber 63 is shown in FIG. 1), the intake device 70, an exhaust device 30, six fuel injection valves 27 (only one fuel injection valve 27 is shown in FIG. 1), and six spark plugs 29 (only one spark plug 29 is shown in FIG. 1).

The combustion chamber 63 of each cylinder is defined by a cylinder head 20, the cylinder block 10, and a piston 3 as shown in FIG. 1. The cylinder head 20 has a plurality of intake ports 23 (only one intake port 23 is shown in FIG. 1) for supplying fresh air to the combustion chambers 63 and a plurality of exhaust ports 24 (only one exhaust port 24 is shown in FIG. 1) for discharging burned gas from the combustion chambers 63 as exhaust gas.

The intake device 70 is configured and arranged to guide fresh air and fuel to each of the combustion chambers 63 through an intake passage 50. A common intake device 70 serves all six of the cylinders. The intake device 70 includes a plurality of intake valves 21 (only one intake valve 21 is shown in FIG. 1), an intake manifold 55, the intake ports 23, and a plurality of runners or intake branches 52 (only one intake branch 52 is shown in FIG. 1). The intake branches 52 are positioned upstream of the intake ports 23. The intake valves 21 are arranged at the downstream ends of the intake ports 23.

The exhaust device 30 is configured and arranged to discharge exhaust gas from the combustion chambers 63. The common exhaust device 30 is connected to all six cylinders. The exhaust device 30 includes a plurality of exhaust valves 22 (only one exhaust valve 22 is shown in FIG. 1), the exhaust ports 24, and a plurality of exhaust branches 31 (only one exhaust branch 31 is shown in FIG. 1). The exhaust branches 31 are positioned downstream of the exhaust ports 24. The exhaust valves 22 are arranged at the upstream ends of the exhaust ports 24.

An intake camshaft 21*b* having a plurality of intake cams 21*a* (only one intake cam 21*a* is shown in FIG. 1) fixed thereto is arranged such that the intake cams 21*a* are positioned above the intake valves 21. The intake camshaft 21*b* is arranged such that it rotates when the crankshaft of the engine 1 rotates. When the intake camshaft 21*b* rotates, the intake cams 21*a* cause the intake valves 21 to open and close. Likewise, an exhaust camshaft 22*b* having a plurality of exhaust cams 22*a* (only one exhaust cam 22*a* is shown in FIG. 1) fixed thereto is arranged such that the exhaust cams 22*a* are positioned above the exhaust valves 22. The exhaust camshaft 22*b* is arranged such that it rotates when the crankshaft of the engine 1 rotates. When the exhaust camshaft 22*b* rotates, the exhaust cams 22*a* cause the exhaust valves 22 to open and close.

One fuel injection valve 27 is provided with respect to each cylinder and each fuel injection valve 27 is configured and arranged to inject fuel (gasoline) into the respective intake port 23. The tip end of the fuel injection valve 27 protrudes into the intake port 23 as shown in FIG. 1.

One spark plug 29 is provided with respect to each cylinder and each spark plug 29 is arranged to extend into the respective combustion chamber 63 from a portion of the cylinder head 20 positioned above the approximate center of the combustion chamber 63. The tip end portion 29*a* of the spark plug 29 protrudes into the combustion chamber 63.

Overview of Operation of Internal Combustion Engine

In the engine 1, fresh air introduced into the intake branches 52 is guided to the intake ports 23. Pressurized fuel supplied to the fuel injection valves 27 is injected into the fresh air guided into the intake ports 23. As a result, a mixture of fresh air and fuel is formed in the intake ports 23.

In the intake stroke of any given cylinder, the intake valve 21 is opened by the intake cam 21*a* and the mixture of fresh air and fuel formed in the intake port 23 is introduced into the combustion chamber 63 from the intake port 23.

During the compression stroke, the piston 3 rises and the mixture of fresh air and fuel inside the combustion chamber 63 is compressed. Then, at a prescribed timing, the tip end portion 29*a* of the spark plug 29 ignites the mixture of fresh air and fuel inside the combustion chamber 63, thereby causing the air-fuel mixture to combust.

During the power stroke, the combustion pressure generated by the combustion of the mixture of fresh air and fuel pushes the piston 3 downward.

During the exhaust stroke, the exhaust cam 22*a* opens the exhaust valve 22 and burned gas remaining after combustion in the combustion chamber 63 is discharged as exhaust gas to the exhaust branch 31 through the exhaust port 24.

Accordingly, the engine 1 is configured to have the mixture of fresh air and fuel inducted into combustion chambers 63 from the intake device 70. The mixture of fresh air and fuel is combusted inside the combustion chambers 63 and the combustion causes pistons 3 to move reciprocally inside cylinders. The reciprocal motion of the pistons 3 is converted into rotational motion of a crankshaft of the engine 1 by means of connecting rods (not shown).

Overview of Structure of Internal Combustion Engine Intake Device

Figure 2:
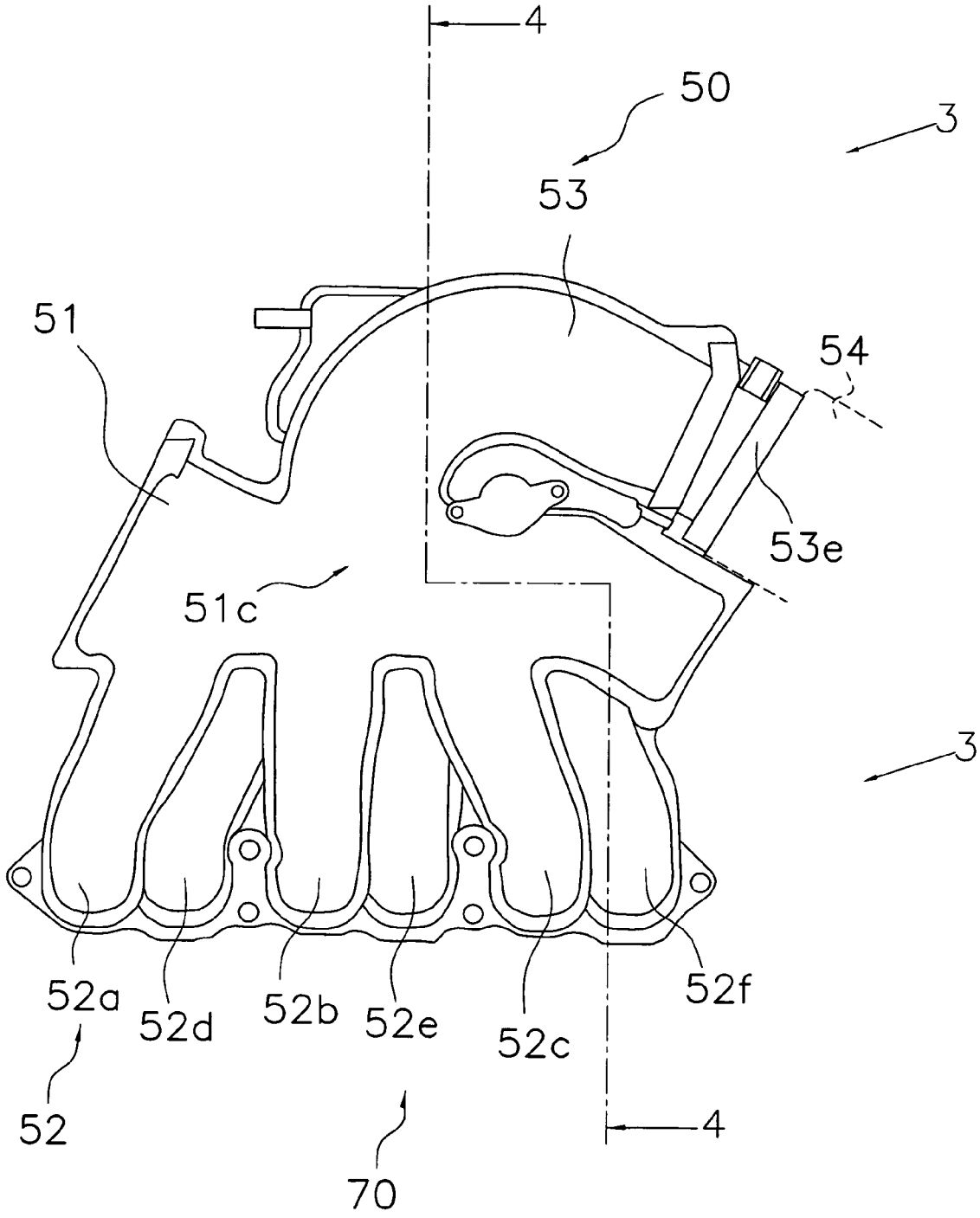
FIG. 2 is a top plan view of the internal combustion engine intake device in accordance with the embodiment of the present invention.
Figure 3:
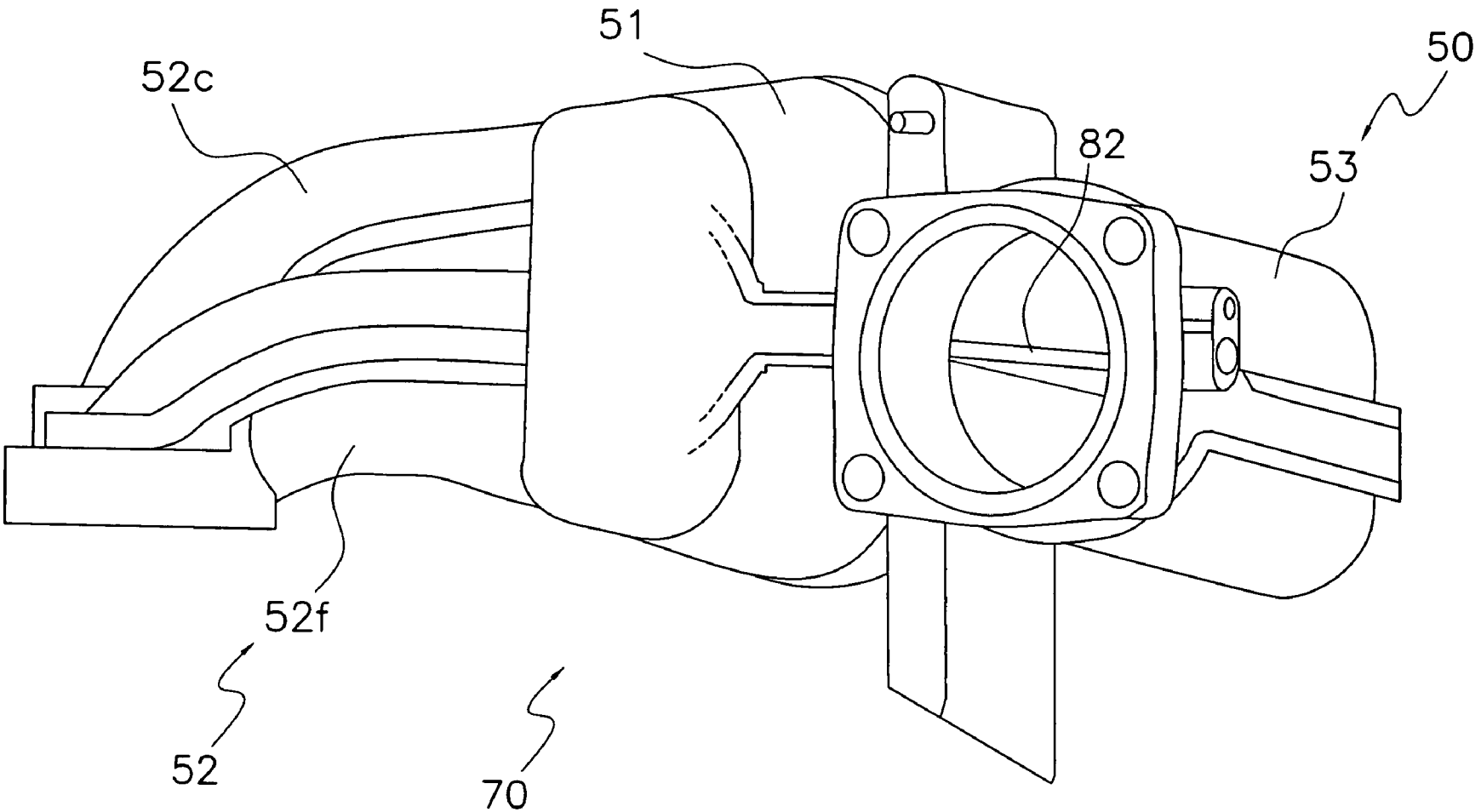
FIG. 3 is a side elevational view of the internal combustion engine intake device taken from the direction of arrows 3 of FIG. 2 in accordance with the embodiment of the present invention.
Figure 4:
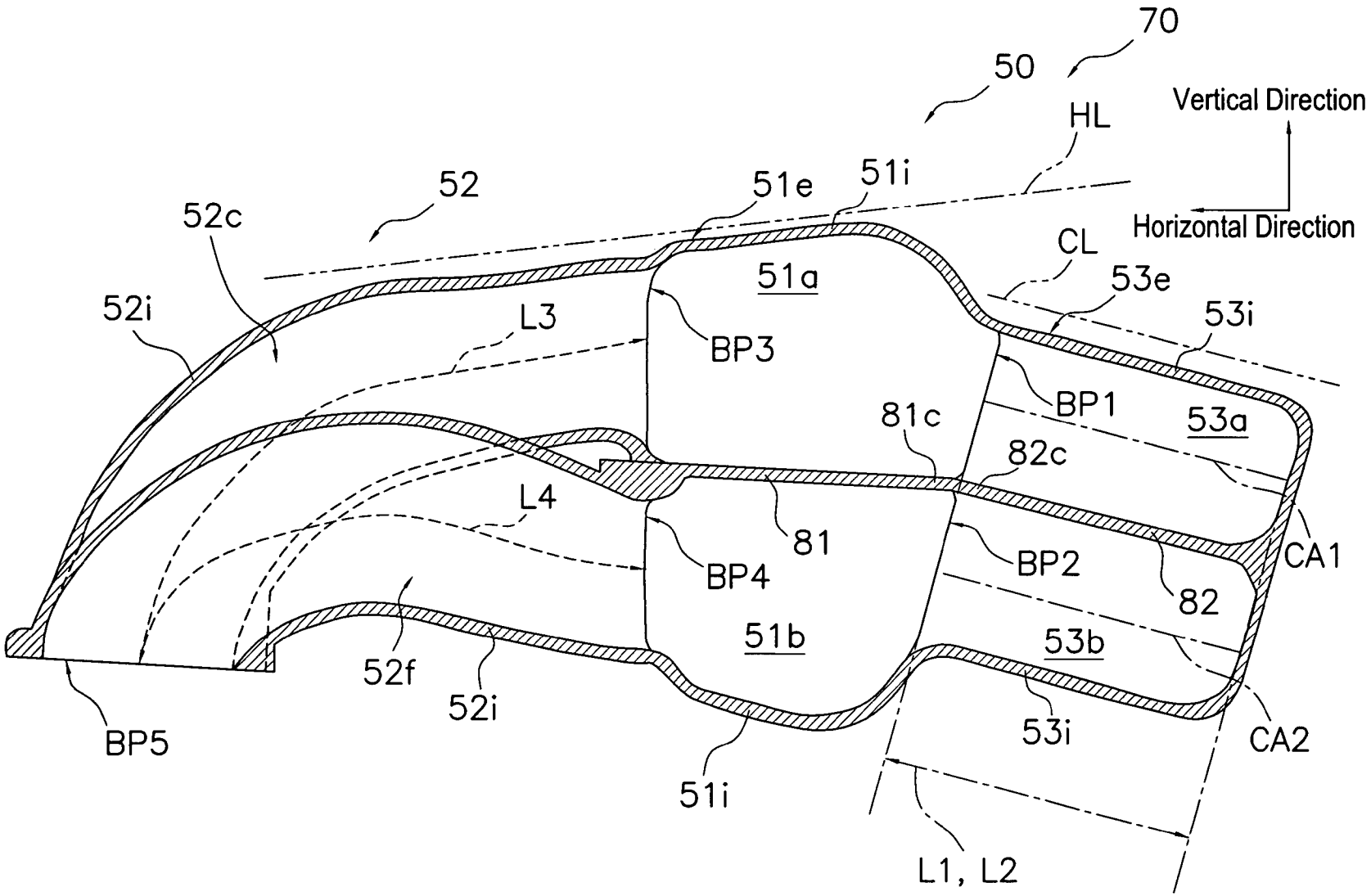
FIG. 4 is a cross sectional view of the internal combustion engine intake device in accordance with the embodiment of the present invention taken along a section line 4-4 of FIG. 2.

A top plan view of the intake device 70 is shown in FIG. 2. FIG. 3 is a side elevational view of the comparison example of the intake device 70 from the direction of the arrows 3 of FIG. 2. FIG. 4 is a cross sectional view of the intake device 70 taken along a section line 4-4 of FIG. 2.

As shown in FIGS. 1 to 4, the intake device 70 includes the intake passage 50, a throttle valve 91 (see FIG. 1), a first partitioning plate (first partitioning part) 81, and a second partitioning plate (second partitioning part) 82.

The intake passage 50 is the passage through which fresh air flows until it is drawn into the combustion chamber 63. The intake passage 50 includes a throttle chamber 54, a first air induction pipe 53, an intake collector 51, the intake branches 52, the intake manifold 55 and the intake ports 23.

The throttle valve 91 is arranged in the throttle chamber 54. The throttle valve 91 is configured and arranged such that the amount of fresh air flowing through the throttle chamber 54 can be changed by changing the opening degree of the throttle valve 91. As a result, the throttle valve 91 is configured and arranged to adjust the quantity of fresh air taken into the combustion chambers 63.

The first air induction pipe 53 is provided between the throttle chamber 54 and the intake collector 51. As shown in FIG. 2, the first air induction pipe 53 is curved in a substantially circular arc-like shape and serves as a communication passage between the throttle chamber 54 and the intake collector 51. As shown in FIG. 4, the space inside the first air induction pipe 53 is divided by the second partitioning plate 82 into a first air induction space 53*a* and a second air induction space 53*b* such that the first air induction space 53*a* is disposed above the second partitioning plate 82 and the second air induction space 53*b* is disposed below the second partitioning plate 82 with respect to the vertical direction of the vehicle. The first air induction space 53*a* is fluidly communicated with the right-hand cylinder bank 20*a* (FIG. 7) and the second air induction space 53*b* is fluidly communicated with the left-hand cylinder bank 20*b* (FIG. 7). The second partitioning plate 82 is configured and arranged to extend from the vicinity of the throttle valve 91 (i.e., a position near a flange 53*e* and downstream than the flange 53*e*) to a position where the intake collector 51 begins.

As shown in FIG. 4, the intake collector 51 is enclosed by a collector wall 51*i*. The intake collector 51 is arranged downstream of the throttle valve 91 and the first air induction pipe 53. The intake collector 51 has the form of a generally rectangular box and the first air induction pipe 53 connects thereto in the vicinity of a central portion 51*c* thereof. The space inside the intake collector 51 is divided by the first partitioning plate 81 into a first collector space 51*a* and a second collector space 51*b* such that the first collector space 51*a* is disposed above the first partitioning plate 81 and the second collector space 51*b* is disposed below the first partitioning plate 81 with respect to the vertical direction of the vehicle. The first collector space 51*a* is fluidly communicated with the right-hand cylinder bank 20*a* (FIG. 7) and the second collector space 51*b* is fluidly communicated with the left-hand cylinder bank 20*b* (FIG. 7). The end portion 81*c* of the first partitioning plate 81 located close to the first air induction pipe 53 joins the end portion 82*c* of the second partitioning plate 82 located close to the intake collector 51 in a smooth and uninterrupted manner as shown in FIG. 4. Consequently, the first collector space 51*a* communicates with the first air induction space 53*a* but does not communicate with the second air induction space 53*b*. Similarly, the second collector space 51*b* communicates with the second air induction space 53*b* but does not communicate with the first air induction space 53*a*.

As seen in FIG. 4, the intake branches 52 are enclosed by branch walls 52*i*. The intake branches are arranged between the intake collector 51 and the cylinder head 20. The intake branches 52 are connected to the opposite side of the intake collector 51 as the first air induction pipe 53. There is one intake branch 52 provided with respect to the intake ports 23 of each of the left and right cylinder banks (FIG. 2 shows an example in which there are six cylinders). More specifically, the intake branches 52 include a first intake branch having a first branch pipe 52*a*, a second branch pipe 52*b*, a third branch pipe 52*c*, and a second intake branch includes a fourth branch pipe 52*d*, a fifth branch pipe 52*e*, and a sixth branch pipe 52*f*. The first branch pipe 52*a*, the second branch pipe 52*b*, and the third branch pipe 52*c* of the first intake branch serve the right-hand cylinder bank 20*a* and are configured to extend from the first collector space 51*a* to the respective intake ports 23 of the right bank cylinders via the intake manifold 55. The fourth branch pipe 52*d*, the fifth branch pipe 52*e*, and the sixth branch pipe 52*f* of the second intake branch serve the left-hand cylinder bank 20*b* and are configured to extend from the second collector space 51*b* to the respective intake ports 23 of the left bank of cylinders via the intake manifold 55.

Overview of Operation of Internal Combustion Engine Intake Device

The throttle valve 91 is opened to a prescribed opening degree based on a command from an ECU (not shown). The quantity of fresh air taken in is adjusted according to the opening degree of the throttle valve 91. The fresh air passes through the throttle chamber 54 and into the first air induction pipe 53. The fresh air introduced into the first air induction pipe 53 is divided into a portion that flows through the first air induction space 53*a* toward the intake collector 51 and a portion that flows through the second air induction space 53*b* toward the intake collector 51. Consequently, the pulsations of the fresh air in the first air induction space 53*a* can be offset so as to be out of phase with the pulsations of the fresh air in the second air induction space 53*b*, thereby enabling resonance to be utilized with respect to the intake of air.

The fresh air in the first air induction space 53*a* is directed to the first collector space 51*a*. The fresh air introduced into the first collector space 51*a* is directed to the intake ports 23 of the right-hand bank of cylinders via the first branch pipe 52*a*, the second branch pipe 52*b* and the third branch pipe 52*c*, and the intake manifold 55.

The fresh air in the second air induction space 53*b* is directed to the second collector space 51*b*. The fresh air introduced into the second collector space 51*b* is directed to the intake ports 23 of the left-hand bank of cylinders via the fourth branch pipe 52*d*, the fifth branch pipe 52*e* and the sixth branch pipe 52*f*, and the intake manifold 55.

Comparsion Example Internal Combustion Engine Intake Device

Figure 5:
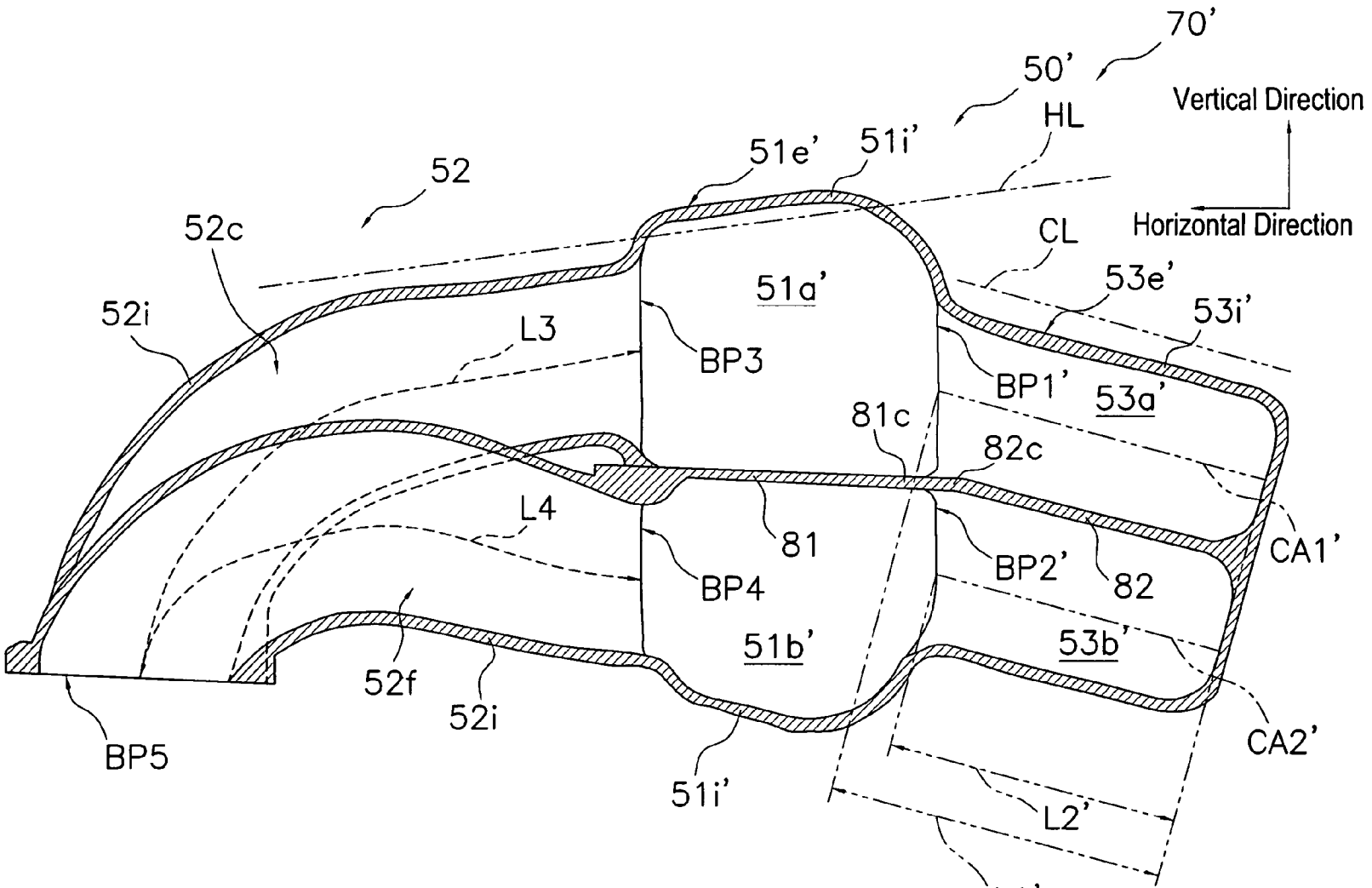
FIG. 5 is a cross sectional view of a comparison example of an internal combustion engine intake device corresponding to a view taken along the section line 4-4 of FIG. 2.

In order to better explain the present invention, a comparison example of an internal combustion engine intake device 70' will be first discussed in detail. FIG. 5 is a cross sectional view of the comparison example of the intake device 70' corresponding to a view taken along the section line 4-4 of FIG. 2.

Detailed Description of First Air Induction Pipe (Comparison Example)

As shown in FIG. 5, a first air induction pipe 53' extends diagonally downward from an intake collector 51'. More specifically, a first air induction space 53*a'* extends diagonally downward from a first collector space 51*a'* and a second air induction space 53*b'* extends diagonally downward from a second collector space 51*b'*. Consequently, a top surface 53*e'* of the first air induction pipe 53' also slants diagonally downward from a top surface 51*e'* of the intake collector 51'. As a result, the top surface 53*e'* is maintained below a cowl top restriction line CL so that a gap is secured between the first air induction pipe 53' and the cowl top (not shown in FIG. 5).

A first boundary plane BP1' is substantially parallel to the vertical direction of the vehicle and substantially coplanar with respect to a second boundary plane BP2'. The first boundary plane BP1' is defined between the first air induction space 53*a'* and the first collector space 51*a'*. The second boundary plane BP2' is defined between the second air induction space 53*b'* and the second collector space 51*b'*. The first air induction pipe 53' is arranged so that an air flow direction CA1' in the first air induction space 53*a'* is substantially parallel to an air flow direction CA2' in the second air induction space 53*b'* and is oriented such that the fresh air approaches the first collector space 51*a'* from a diagonally downward direction. Consequently, a flow path length L1' of the first air induction space 53*a'* is longer than a flow path length L2' of the second air induction space 53*b'* as viewed in FIG. 5. In other words, a distance over which the intake air travels in the first air induction space 53*a'* before reaching the first collector space 51*a'* is longer than a distance over which the intake air travels in the second air induction space 53*b'* before reaching the second collector space 51*b*'. As a result, the intake characteristics of the right-hand cylinder bank downstream of the first air induction space 53*a*' are different from the intake characteristics of the left-hand cylinder bank downstream of the second air induction space 53*b*' and, thus, the characteristics of the left and right cylinder banks tend to be less than perfectly balanced. For example, the improvement in volumetric efficiency resulting from the induction pipe effect of the first air induction space 53*a*' is different from the improvement in volumetric efficiency resulting from the second air induction space 53*b*'.

Detailed Description of Intake Collector (Comparison Example)

The top surface 51*e*' of the intake collector 51' needs to be low with respect to the engine hood (not shown in FIG. 5). However, the height of the top surface 51*e*' of the comparison example of the intake collector 51' illustrated in FIG. 5 tends to be high with respect to the engine hood because a third boundary plane BP3, a fourth boundary plane BP4, and a fifth boundary plane BP5 need to be kept fixed, the length L3 of the third branch pipe 52*c* and the length L4 of the sixth branch pipe 52*f* need to be kept substantially equal, and the volume of the first air induction space 53*a*' and the volume of the second air induction space 53*b*' need to be kept substantially the same. The third boundary plane BP3 is defined between the space inside the third branch pipe 52*c* and the first collector space 51*a*'. The fourth boundary plane BP4 is defined between the space inside the sixth branch pipe 52*f* and the second collector space 51*b*'. The fifth boundary plane BP5 is defined between the spaces inside the third branch pipe 52*c* and sixth branch pipe 52*f* and the spaces inside the respective intake ports 23. Consequently, the top surface 51*e*' of the comparison example of the intake collector 51' is arranged above a hood restriction line HL as shown in FIG. 5, and thus, it is difficult to secure a sufficient space (gap) between the intake collector 51' and the engine hood in the intake device 70' of the comparison example.

In the intake collector 51' of the comparison example, the height of the first air induction space 53*a*' is substantially equal to the height of the second collector space 51*b*' are substantially. Additionally, the arrangements between the first branch pipe 52*a* and fourth branch pipe 52*d* with respect to the intake collector 51' are the same as the arrangements between the second branch pipe 52*b* and fifth branch pipe 52*e* with respect to the intake collector 51' and the arrangements between the third branch pipe 52*c* and the sixth branch pipe 52*f* with respect to the intake collector 51'.

Internal Combustion Engine Intake Device of the Present Invention

Figure 6:
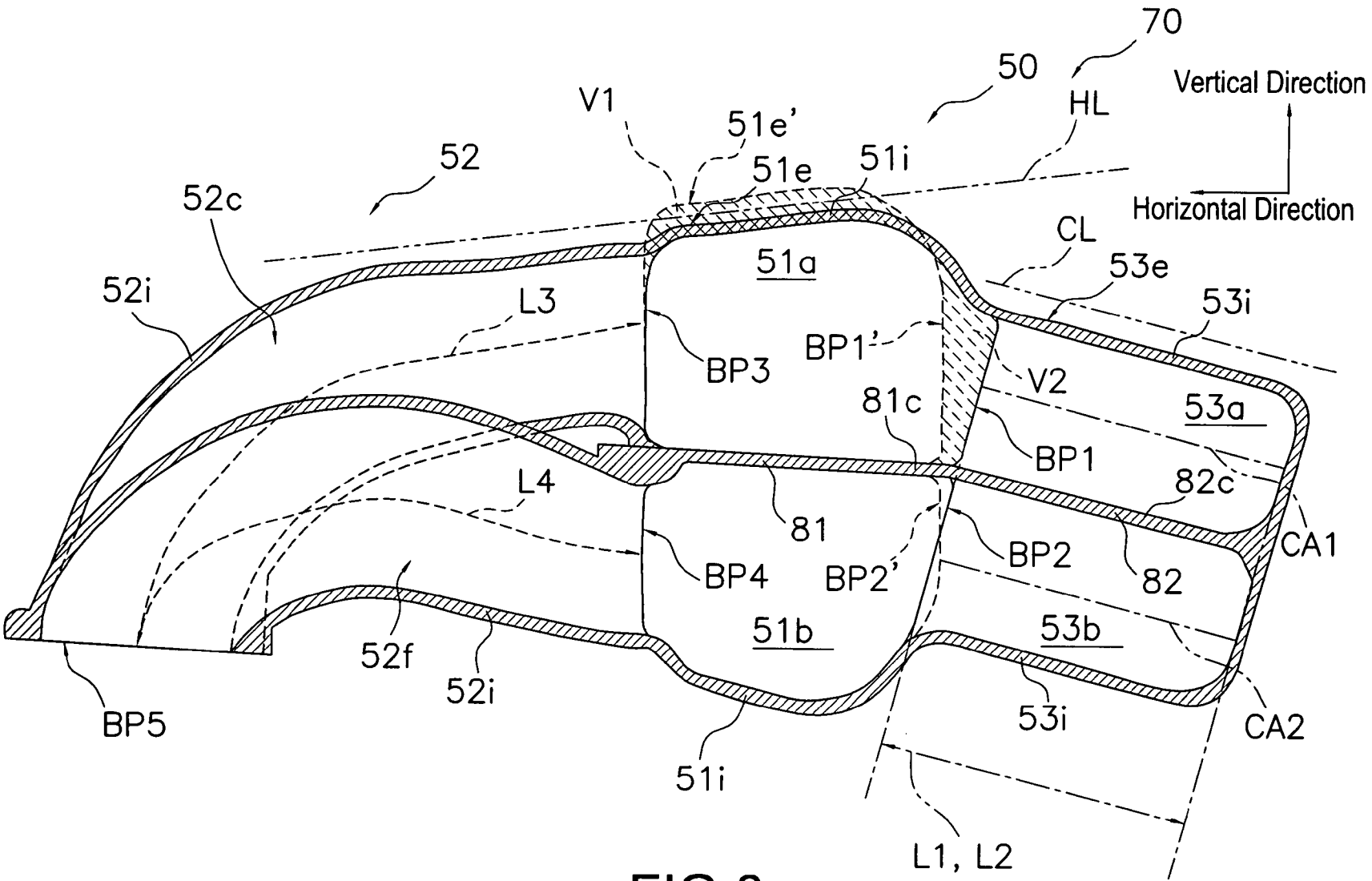
FIG. 6 is a cross sectional view of the internal combustion engine intake device taken along the section line 4-4 of FIG. 2 illustrating a comparison between the embodiment of the present invention illustrated in FIG. 5 and the comparison example illustrated in FIG. 4.

Referring back to FIG. 4, the intake device 70 in accordance with the embodiment of the present invention will now be explained. FIG. 6 is a cross sectional view of the internal combustion engine intake device taken along the section line 4-4 of FIG. 2 illustrating a comparison between the embodiment of the present invention illustrated in FIG. 4 and the comparison example illustrated in FIG. 5. FIG. 7 is a partial cross sectional view illustrating arrangements of the intake device 70, the engine 1, an engine hood 80 and a cowl top panel 90 in accordance with the embodiment of the present invention.

The explanation will focus mainly on the differences with respect to the previously described intake device 70' of the comparison example illustrated in FIG. 5. Constituent components that are the same as the components of the previously described intake device 70' of the comparison example are indicated using the same reference numerals and explanations thereof are omitted.

Detailed Description of First Air Induction Pipe (Present Invention)

As shown in FIGS. 4 and 6, the first air induction pipe 53 of the present invention extends diagonally downward from the upstream side of the intake collector 51. More specifically, the first air induction space 53*a* extends diagonally downward from the first collector space 51*a* and the second air induction space 53*b* extends diagonally downward from the second collector space 51*b*. Consequently, the top surface 53*e* of the first air induction pipe 53 also slants diagonally downward from the top surface 51*e* of the intake collector 51. As a result, the top surface 53*e* is maintained below a cowl top restriction line CL as shown in FIG. 4. Therefore, the top surface 53*e* of the first air induction pipe 53 is substantially parallel to the cowl top panel 90, and a gap is secured between the first air induction pipe 53 and the cowl top panel 90, which is arranged above the first air induction pipe 53 such that the cowl top panel 90 slants upward toward the front of the vehicle as shown in FIG. 7. Moreover, the top surface 51*e* of the intake collector 51 slants slightly downward toward the opposite side as the side where the first air induction pipe 53 is located as shown in FIG. 4.

As shown in FIG. 6, a first boundary plane BP1 is slanted with respect to the first and second boundary planes BP1' and BP2' of the comparison example that are substantially parallel to the vertical direction of the vehicle. More specifically, the first boundary plane BP1 is slanted so as to be substantially perpendicular to the air flow direction CA1 in the first air induction space 53*a* (i.e. a direction of an intake air flow from the first air induction space 53*a* into the first collector space 51*a*). A second boundary plane BP2 is substantially coplanar with respect to the first boundary plane BP1 as shown in FIG. 4. The first boundary plane BP1 is defined between the first air induction space 53*a* and the first collector space 51*a*. The second boundary plane BP2 is defined between the second air induction space 53*b* and the second collector space 51*b*. The air flow direction CA1 in the first air induction space 53*a* is substantially parallel to the air flow direction CA2 in the second air induction space 53*b* and is oriented such that the fresh air approaches the first collector space 51*a* from a diagonally downward direction. Consequently, an air flow path length L1 of the first air induction space 53*a* is substantially equal to an air flow path length L2 of the second air induction space 53*b* as viewed in FIG. 4. In other words, a distance over which the intake air travels in the first air induction space 53*a* before reaching the first collector space 51*a* is substantially equal to a distance over which the intake air travels in the second air induction space 53*b* before reaching the second collector space 51*b*. As a result, the intake characteristics of the right-hand cylinder bank 20*a* (FIG. 7) downstream of the first air induction space 53*a* are substantially equal to the intake characteristics of the left-hand cylinder bank 20*b* (FIG. 7) downstream of the second air induction space 53*b*. For example, the improvement in volumetric efficiency resulting from the induction pipe effect of the first air induction space 53*a* and the improvement in volumetric efficiency resulting from the second air induction space 53*b* are substantially the same.

Detailed Description Intake Collector (Present Invention)

The top surface 51*e* of the intake collector 51 needs to be low with respect to the engine hood 80 (FIG. 7). As shown in FIG. 7, the engine hood 80 is arranged above the intake collector 51 so that the engine hood 80 slants downward toward the front of the vehicle. Meanwhile, the third boundary plane BP3, the fourth boundary plane BP4, and the fifth boundary plane BP5 need to be kept fixed, the length L3 of the third branch pipe 52*c* and the length L4 of the sixth branch pipe 52*f* need to be kept substantially equal, and the volume of the first air induction space 53*a* and the volume of the second air induction space 53*b* need to be kept substantially the same.

Similarly to the previously described comparison example illustrated in FIG. 5, the first air induction pipe 53 of the present invention extends diagonally downward from the intake collector 51. Moreover, in the embodiment of the present invention, the first boundary plane BP1 is slanted with respect to the vertical direction of the vehicle so as to be substantially perpendicular to the flow direction CA1 in the first air induction space 53*a* (i.e. a direction of an intake air flow from the first air induction space 53*a* into the first collector space 51*a*) and the second boundary plane BP2 is substantially coplanar with respect to the first boundary plane BP1. As a result, as shown in FIG. 6, since the first collector space 51*a* can be expanded beyond the first boundary plane BP1' of the comparison example in toward the upstream direction so as to increase the volume thereof by an amount V2 in comparison with the first collector space 51*a*' (FIG. 5), the height dimension of the first collector space 51*a* can be made smaller than the height dimension of the second collector space 51*b* (thereby eliminating the volume of the first collector space 51*a* corresponding to the volume V1) while keeping the volume of the first collector space 51*a* and the volume of the second collector space 51*b* substantially equal. In short, the top surface 51*e* of the intake collector 51 can easily be lowered with respect to the engine hood and the top surface 51*e* of the intake collector can be maintained below a hood restriction line HL so as to secure a gap between the intake collector 51 and the engine hood 80 as shown in FIG. 7.

The intake collector 51 is configured and arranged such that the volume V2 of a portion of the first collector space 51*a* that extends farther upstream than the second collector space 51*b* in the vertical direction of the vehicle is substantially equal to the volume V1 that the first collector space 51*a* loses by having a smaller height dimension than the second collector space 51*b* comparing to the first collector space 51*a*' (FIG. 5). Thus, the volume of the first collector space 51*a* and the volume of the second collector space 51*b* are substantially equal in the embodiment of the present invention.

Furthermore, the volume of the first collector space 51*a* is substantially equal to the volume of the first collector space 51*a*' of the comparison example illustrated in FIG. 5. Additionally, the arrangements between the first branch pipe 52*a* and fourth branch pipe 52*d* with respect to the intake collector 51 are the same as the arrangements between the second branch pipe 52*b* and fifth branch pipe 52*e* with respect to the intake collector 51 and the arrangements between the third branch pipe 52*c* and the sixth branch pipe 52*f* with respect to the intake collector 51.

Accordingly, with the embodiment of the present invention, the first air induction pipe 53 extends diagonally downward from the intake collector 51. Moreover, the first boundary plane BP1 is substantially perpendicular to the flow direction CA1 in the first air induction space 53*a* and substantially coplanar with respect to the second boundary plane BP2.

As a result, since the first collector space 51*a* can be expanded beyond the first and second boundary plane BP1' of the comparison example toward the upstream direction so as to increase the volume thereof by an amount V2 in comparison with the first collector space 51*a*' in FIG. 5, the height dimension of the first collector space 51*a* can be made smaller than the height dimension of the second collector space 51*b* (thereby reducing the volume of the first collector space 51*a* by the amount V1) while keeping the volume of the first collector space 51*a* and the volume of the second collector space 51*b* substantially equal. In short, the top surface 51*e* of the intake collector 51 can easily be lowered with respect to the hood so as to secure a gap between the intake collector 51 and the hood.

Additionally, since the length L1 of the first air induction space 53*a* and the length L2 of the second air induction space 53*b* are substantially equal, the characteristics of the right-hand cylinder bank 20*a* downstream of the first air induction space 53*a* and the characteristics of the left-hand cylinder bank 20*b* downstream of the second air induction space are substantially equal.

In short, a sufficient gap is secured between the intake collector 51 and the engine hood 80 and the characteristics of the right-hand cylinder bank 20*a* downstream of the first air induction space 53*a* and the left-hand cylinder bank 20*b* downstream of the second air induction space 53*b* are substantially equal. As a result, the height of the intake collector 51 can be lowered with respect to the engine hood 80 and good balance can be ensured between the characteristics of the left and right cylinder banks 20*a* and 20*b*.

Moreover, with the embodiment of the present invention, the air flow direction CA1 in the first air induction space 53*a* is substantially parallel to the air flow direction CA2 in the second air induction space 53*b* and is oriented such that the fresh air approaches the first collector space 51*a* from a diagonally downward direction. Consequently, the flow path length L1 of the first air induction space 53*a* and the flow path length L2 of the second air induction space 53*b* are substantially equal.

Furthermore, the intake collector 51 is configured such that the volume V2 of the portion of the first collector space 51*a* that extends farther upstream than the second collector space 51*b* relative to the vertical planes BP1 and BP2 is substantially equal to the volume V1 that the first collector space 51*a* loses by having a smaller height dimension than the second collector space 51*b*. As a result, the volume of the first collector space 51*a* can be kept substantially equal to the volume of the second collector space 51*b* and a good balance can easily be secured between the characteristics of the left and right cylinder banks 20*a* and 20*b*.

Also, with the embodiment of the present invention, the first boundary plane BP1 is substantially perpendicular to the flow direction CA1 in the first air induction space 53*a* and substantially coplanar with respect to the second boundary plane BP2. Consequently, the length L1 of the first air induction space 53*a* and the length L2 of the second air induction space 53*b* are substantially equal. Also, the volume of the first collector space 51*a* and the volume of the second collector space 51*b* are substantially equal. Furthermore, the length L3 of the third branch pipe 52*c* is substantially equal to the length L4 of the sixth branch pipe 52*f*. As a result, the characteristics of the cylinder bank 20*a* downstream of the third branch pipe 52*c* are substantially equal to the characteristics of the cylinder bank 20*b* downstream of the sixth branch pipe 52*f*.

Additionally, the arrangements between the first branch pipe 52*a* and fourth branch pipe 52*d* with respect to the intake collector 51 are the same as the arrangements between the second branch pipe 52*b* and fifth branch pipe 52*e* with respect to the intake collector 51 and the arrangements between the third branch pipe 52*c* and the sixth branch pipe 52*f* with respect to the intake collector 51.

Accordingly, with the present invention, since the first collector space 51*a* can be configured to extend farther upstream with respect to a vertical plane than the second collector space 51*b*, the height of the first collector space 51*a* can be made smaller than the height of the second collector space 51*b* while keeping the volume of the first collector space 51*a* equal to the volume of the second collector space 51*b*. In other words, a sufficient gap can be secured between the intake collector 51 and the engine hood 80 as shown in FIG. 7.

Furthermore, since the first air induction pipe 53 can be configured such that the lengths L1 and L2 of the first air induction space 53*a* and the second air induction space 53*b* are substantially equal, the characteristics of the cylinder bank 20*a* downstream of the first air induction space 53*a* and the cylinder bank 20*b* downstream of the second air induction space 53*b* can be made substantially equal.

Therefore, with an internal combustion engine intake device in accordance with the present invention, a sufficient gap can be secured between the intake collector 51 and the engine hood 80 as shown in FIG. 7 and the characteristics of the cylinder bank 20*a* downstream of the first air induction space 53*a* and the cylinder bank 20*b* downstream of the second air induction space 53*b* can be made substantially equal. As a result, the height of the intake collector can be lowered with respect to the engine hood 80 and good balance can be ensured between the characteristics of the two cylinder banks 20*a* and 20*b*.

Moreover, it is acceptable for the engine 1 to be a conventional flat engine instead of a conventional V-type engine.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Also as used herein to describe the above embodiment(s), the following directional terms "forward, rearward, above, downward, vertical, horizontal, below and transverse" as well as any other similar directional terms refer to those directions of a vehicle equipped with the present invention. Accordingly, these terms, as utilized to describe the present invention should be interpreted relative to a vehicle equipped with the present invention. Moreover, terms that are expressed as "means-plus function" in the claims should include any structure that can be utilized to carry out the function of that part of the present invention.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. An internal combustion engine intake device comprising:

intake air collecting means for collecting an intake air into a first collector space located above a first partitioning part and a second collector space located below the first portioning part with respect to a vertical direction of a vehicle; and air induction means for introducing the intake air to an upstream side of the intake air collecting means from a diagonally downward direction with respect to a horizontal direction of the vehicle such that the intake air is introduced from a first air induction space located above a second partitioning part into the first collector space and from a second air induction space located below the second partitioning part to the second collector space with a first boundary plane defined between the first collector space and the first air induction space being substantially perpendicular to a direction of an intake air flow from the first air induction space into the first collector space and the first boundary plane being substantially coplanar with a second boundary plane defined between the second collector space and the second air induction space.

2. An internal combustion engine intake device comprising:

an intake collector including a first partitioning part that divides a space inside the intake collector into a first collector space located above the first partitioning part and a second collector space located below the first portioning part with respect to a vertical direction of a vehicle; and a first air induction pipe extending diagonally downward from an upstream side of the intake collector with respect to a horizontal direction of the vehicle, the first air induction pipe including a second partitioning part that divides a space inside the first air induction pipe into a first air induction space located above the second partitioning part and a second air induction space located below the second partitioning part with respect to the vertical direction of the vehicle with the first air induction space fluidly communicating with the first collector space and the second air induction space fluidly communicating with the second collector space, and the intake collector and the first air induction pipe being configured and arranged such that a first boundary plane defined between the first collector space and the first air induction space is substantially perpendicular to a direction of an intake air flow from the first air induction space into the first collector space and the first boundary plane is substantially coplanar with a second boundary plane defined between the second collector space and the second air induction space.

3. The internal combustion engine intake device as recited in claim 2, wherein the intake collector is further configured and arranged such that the first collector space extends farther upstream than the second collector space with respect to the vertical direction of the vehicle, and the second collector space has a larger height dimension than the first collector space so that a volume of a portion of the first collector space that extends farther upstream than the second collector space is substantially equal to a volume of a portion of the second collector space that corresponds to an amount by which the height dimension of the second collector exceeds the height dimension of the first collector space.

4. The internal combustion engine intake device as recited claim 2, further comprising a first intake branch extending from a downstream side of the intake collector and fluidly communicating with the first collector space; and a second intake branch extending from the downstream side of the intake collector and fluidly communicating with the second collector space, the intake collector being further configured and arranged such that a volume of the first collector space is substantially equal to a volume of the second collector space, and a length of the first intake branch being substantially equal to a length of the second intake branch.

5. The internal combustion engine intake device as recited in claim 2, further comprising an internal combustion engine coupled to the intake collector, the internal combustion engine being transversely disposed in an engine compartment at the front of the vehicle, the first air induction pipe being disposed below a cowl top panel that slants upward toward the front of the vehicle, and a top surface of the first air induction pipe being disposed substantially parallel to the cowl top panel.

6. The internal combustion engine intake device as recited in claim 2, wherein the intake collector is disposed below an engine hood that slants downward toward the front of the vehicle.

7. The internal combustion engine intake device as recited in claim 2, wherein the intake collector is further configured and arranged such that a volume of the first collector space is substantially equal to a volume of the second collector space.

8. The internal combustion engine intake device as recited in claim 2, wherein the intake collector and the first air induction pipe are configured and arranged such that a direction of the intake air flow in the first air induction space is substantially parallel to a direction of the intake air flow in the second air induction space, and the intake air flow in the first induction pipe is oriented to approach the first collector space from a diagonally downward direction with respect to the horizontal direction of the vehicle.

9. The internal combustion engine intake device as recited in claim 8, further comprising an internal combustion engine coupled to the intake collector, the internal combustion engine being transversely disposed in an engine compartment at the front of the vehicle, the first air induction pipe being disposed below a cowl top panel that slants upward toward the front of the vehicle, and a top surface of the first air induction pipe being disposed substantially parallel to the cowl top panel.

10. The internal combustion engine intake device as recited in claim 8, wherein the intake collector is disposed below an engine hood that slants downward toward the front of the vehicle.

11. The internal combustion engine intake device as recited in claim 8, wherein the intake collector is further configured and arranged such that a volume of the first collector space is substantially equal to a volume of the second collector space.

12. The internal combustion engine intake device as recited in claim 8, wherein the intake collector is further configured and arranged such that the first collector space extends farther upstream than the second collector space with respect to the vertical direction of the vehicle, and the second collector space has a larger height dimension than the first collector space so that a volume of a portion of the first collector space that extends farther upstream than the second collector space is substantially equal to a volume of a portion of the second collector space that corresponds to an amount by which the height dimension of the second collector exceeds the height dimension of the first collector space.

13. The internal combustion engine intake device as recited claim 12, further comprising a first intake branch extending from a downstream side of the intake collector and fluidly communicating with the first collector space; and a second intake branch extending from the downstream side of the intake collector and fluidly communicating with the second collector space, the intake collector being configured and arranged such that a volume of the first collector space is substantially equal to a volume of the second collector space, and a length of the first intake branch being substantially equal to a length of the second intake branch.

* * * * *